US006079649A

United States Patent [19]

Balvanz et al.

[11] Patent Number: 6,079,649

[45] Date of Patent: Jun. 27, 2000

[54] MILLENNIUM ROTOR ASSEMBLY

[75] Inventors: Loran R. Balvanz; Paul R. Gray, both of New Providence, Iowa

[73] Assignee: US Manufacturing, New Providence, Iowa

[21] Appl. No.: 09/185,268

[22] Filed: Nov. 3, 1998

[51] Int. Cl.[7] ..... B02C 13/02

[52] U.S. Cl. ..... 241/189.1; 241/191; 241/195; 241/197; 241/293; 241/300

[58] Field of Search ..... 241/189.1, 191, 241/195, 197, 192, 293, 294, 295, 300

[56] References Cited

U.S. PATENT DOCUMENTS

| | | | |
|---|---|---|---|
| 797,616 | 8/1905 | Schutz | 241/191 |
| 1,294,203 | 2/1919 | Tyler | 241/186.4 |
| 2,322,460 | 6/1943 | Mankoff | 241/192 |
| 3,680,797 | 8/1972 | Covey | 241/73 |
| 3,980,235 | 9/1976 | Kuhlman . | |
| 4,180,213 | 12/1979 | Endo . | |
| 4,315,605 | 2/1982 | Vargo, Jr. | 241/192 |
| 4,373,678 | 2/1983 | Reitter . | |
| 4,702,426 | 10/1987 | Citterio . | |
| 4,739,939 | 4/1988 | Panning . | |
| 4,770,351 | 9/1988 | Ferrero . | |
| 4,773,600 | 9/1988 | Metski . | |
| 4,907,750 | 3/1990 | Seifert . | |
| 5,044,809 | 9/1991 | Galanty . | |
| 5,255,860 | 10/1993 | Timmons . | |
| 5,704,562 | 1/1998 | Wagstaff . | |
| 5,775,608 | 7/1998 | Dumaine et al. . | |
| 5,785,263 | 7/1998 | Wu et al. | 241/79.1 |
| 5,887,808 | 3/1999 | Lucas | 241/82 |
| 5,941,467 | 8/1999 | McArdle et al. | 241/5 |

FOREIGN PATENT DOCUMENTS

| | | |
|---|---|---|
| 4-5329390 | 12/1993 | Japan . |
| 2 019 741 | 3/1979 | United Kingdom . |

*Primary Examiner*—John M. Husar
*Attorney, Agent, or Firm*—Kent A. Herink; Daniel A. Rosenberg; Davis Brown Law Firm

[57] ABSTRACT

A rotor assembly for use with size reducing machines having a drive motor comprising a central shaft with a drive end for securement to the drive motor and an opposing outboard end. The rotor assembly also comprises a webbing engaged with the central shaft for supporting the rotor assembly, a rotor casing substantially seals the webbing, and a plurality of sockets secure to a plurality of casing throughbores. The webbing comprises a drive end plate secured to the central shaft with a bushing, an outboard end plate secured to the central shaft with a bushing, and a plurality of web socket supports aligned in two transversely aligned rows. The web socket plates each comprise two socket receiver channels for alignment with the sockets. Finally, a plurality of hammers releasably secure to the plurality of sockets.

15 Claims, 18 Drawing Sheets

FRONT VIEW

SIDE VIEW

TOP VIEW

SECTION VIEW
26
82
88
80
78
81
76
79
83
84
77
A

MILLENNIUM ROTOR ASSEMBLY

BACKGROUND OF THE INVENTION

The present invention relates to a rotor assembly, and more particularly to a rotor assembly with a central shaft, a webbing engaged with the central shaft, and a casing engaged with the webbing.

Rotor assemblies used in conjunction with size reducing machine (such as tub grinders, rotary hammermills, vertical feed machines, and the like) experience a number of problems associated with the operation and maintenance of the size reducing machines. For example, the powerful and violent interaction between the rotor assembly and the matter being size reduced causes a great deal of wear on any exposed surfaces. In particular, the more the debris is focused away from the hammer tips the less efficiently the size reducing machine operates. Prior art size reducing machines suffer from this problem.

Prior art rotor assemblies utilize a complex arrangement of parts. The parts include a plurality of hammers secured in rows substantially parallel to a central shaft. The hammers secure to a plurality of plates, wherein each plate orients about the central shaft. The plates also contain a number of distally located throughbores. Pins, or rods, align through the throughbores of the plates and through throughbores in the hammers. Additionally, spacers align between the plates. All these parts require careful and precise alignment relative to each other, and in the case of disassembly for the purposes of repair and replacement of worn or damaged parts, this can cause considerable difficulties. Moreover, the parts of the rotor assembly are usually keyed to each other, or at least to the central shaft, this further complicates the assembly and disassembly process. For example, the replacement of a single hammer can require disassembly of the entire rotor. This comprises an extremely difficult and time-consuming task, which considerably reduces the operating time of the size reducing machine. In some cases removing a single damaged hammer can take in excess of five hours, due to both the rotor design and to the alignment difficulties related to the problems caused by impact of debris with the non-impact surfaces of the rotor assembly.

Prior art rotor assemblies expose a great deal of the surface area of the rotor parts to debris. The plates, the spacers, and hammers all receive considerable contact with the debris. This not only creates excessive wear, but contributes to alignment difficulties by bending and damaging the various parts. Thus, after a period of operation prior art rotor assemblies become even more difficult to disassemble and reassemble. Moreover, the effects of this normal wear and tear also contributes to balancing problems, especially considering that the rotor spins at 1100 to 1900 rpm. The design of the prior art rotor assemblies also contributes to the difficulty in balancing the rotor, since the rotor assemblies require balancing from the center shaft out to the hammers. The shock load of the rotor impacts on the hammers, spacers, plates, pins, and the central shaft. Damage to any part can effect the rotor balance.

Prior art rotor assemblies sometimes attempt to alleviate the problems of alignment by using over-sized components, or in other words deliberately introducing play into the system. The play allows room to move the pins in and out, for example. This, however, merely increases the opportunity for debris to wedge between the parts, which further damages the parts, and increases the need for maintenance. In some cases, due to the play in the rotor system, debris can jam the rotor to the point of preventing operation of the size reducing machine. At this point, maintenance and repair becomes extremely difficult, time consuming, and costly.

Another drawback of prior art rotors comprises the fact that at least the exterior of the rotor components come into contact with debris during operation. Ideally the most efficient operation occurs when only the impact surfaces of the hammer tips encounter the debris. An open rotor assembly exposes the surface of the rotor assembly parts to debris. This not only increases the wear on these parts, but all this residual contact consumes power. Any power directed away from the hammer tips contributes to inefficient operation. The non-wear surfaces of the rotor assembly components simply does not size reduce matter with the efficiency of the hammer tips.

Conventional prior art rotor assemblies arrange the hammers in rows parallel with the axis of the center shaft. This means an entire row of hammers strike the debris simultaneously, and this takes a great deal of power. Additionally, this configuration maximizes the amount of strike force transferred to the rotor assembly, which in turn further increases the amount of wear and tear on the system. In practical terms the use of the pins, or rods, to secure the plates and hammers forces the hammers into a configuration that is parallel to the pins. Thus, prior art rotors, generally, can only configure the hammers in straight rows that align parallel to the central shaft. Accordingly, the prior art rotor assemblies do not easily allow for varying the configuration of the hammers.

Based on the foregoing, those of ordinary skill in the art will realize that a need exists for a rotor assembly that provides for reduced maintenance, for more efficient operation, and for more flexible removal and configuration of the hammers.

SUMMARY OF THE INVENTION

An object of the present invention comprises providing a rotor assembly for a size reducing machine having a drive motor.

This and other objects of the present invention will become apparent to those skilled in the art upon reference to the following specification, drawings, and claims.

The present invention intends to overcome the difficulties encountered heretofore. To that end, a rotor assembly for use with size reducing machines comprises a central shaft with a drive end for securement to the drive motor and an opposing outboard end. The rotor assembly also comprises a webbing engaged with the central shaft for supporting the rotor assembly, a rotor casing substantially seals the webbing, and a plurality of sockets secured to a plurality of casing through bores. Finally, a plurality of hammers releasably secure to the plurality of sockets.

DETAILED DESCRIPTION OF THE INVENTION

Figure 16B:
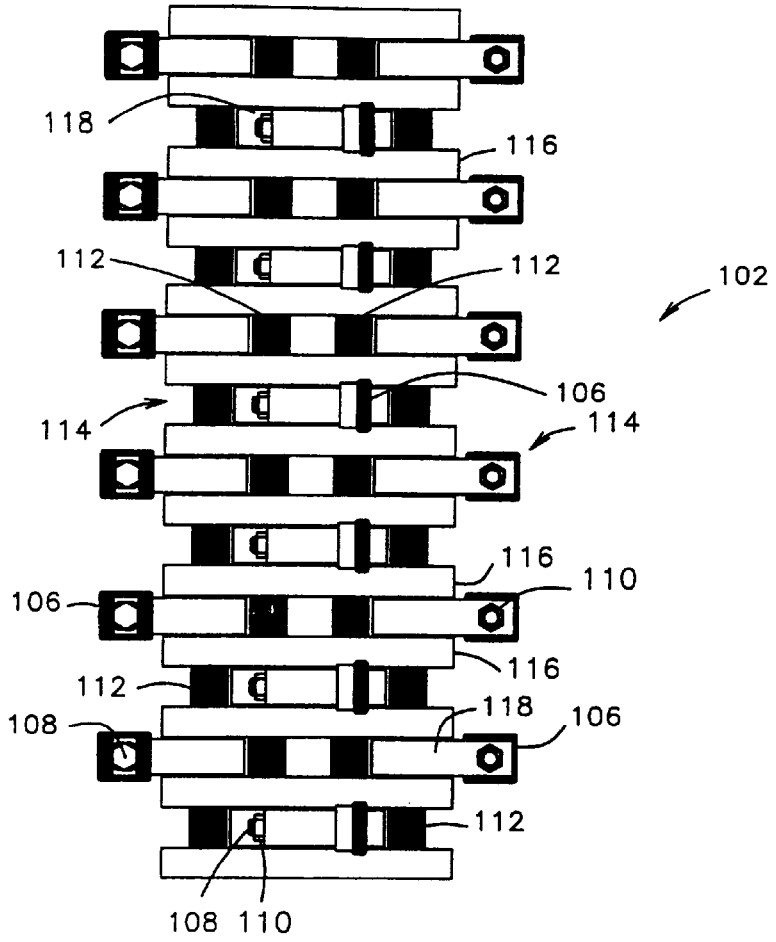
Fig 16b (Prior Art)
FIG. 16*b* is a top plan view of the prior art rotor assembly of FIG. 16*a*.
Figure 16A:
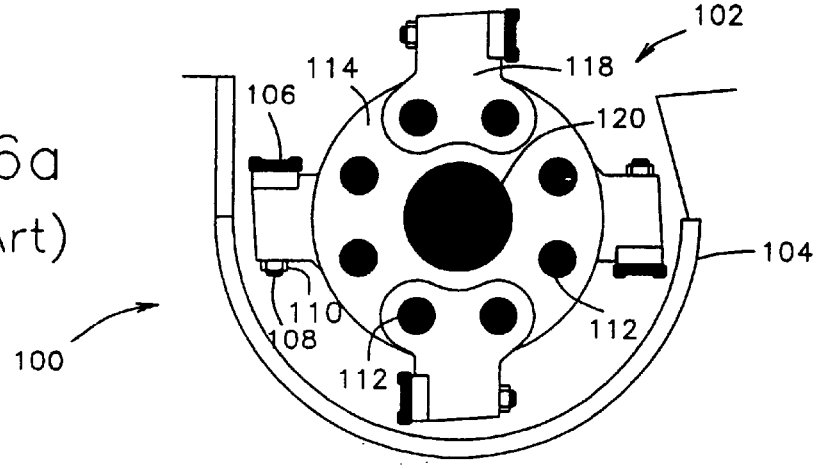
Fig 16a (Prior Art)
FIG. 16*a* is a cross-sectional view of a prior art rotor assembly.

In the Figures, FIGS. 16*a–b* shows a prior art size reducing machine 100, comprising a rotor assembly 102, and a screen 104. The rotor assembly 102 comprises a plurality of hammers 118, plates 114, spacers 116, and pins 112 that all rotate about a central shaft 120. The pins 112 pass-through throughbores in the plates 114, the spacers 116, and hammers and 118. FIG. 16*b* shows a top view of the rotor assembly 102 with the pins 112 shown passing through the each of the plurality of spacers 116, plates 114, and hammers 118. Additionally, each of the plates 114 further comprises a pair of diametrically opposed hammers 118. Secured to each hammer 118 is a hammer tip 106, a bolt 108, and nut 110 thereby providing the means for securing the hammer tips 106 to the hammers 118.

FIGS. 16*a–b* clearly show the difficulty of removing and replacing a component of the prior art rotor assembly 102. Even removing one hammer 118 requires pulling the pins 112. Any irregularities in the alignment of the components of the rotor assembly 102 greatly increases the difficulty of this task. Additionally, FIG. 16*b* shows that a great deal of the surface area of the components of the rotor assembly 102 are exposed to residual contact with debris. This leads not only to damage of the components of the rotor assembly 102, but also to jamming. This eventually necessitates replacement of the worn and damaged parts. Of course, the more the components of the rotor assembly come into contact with debris, the more they wear, the more difficult disassembly and reassembly becomes, and the more frequent such repairs are required.

Figure 1:
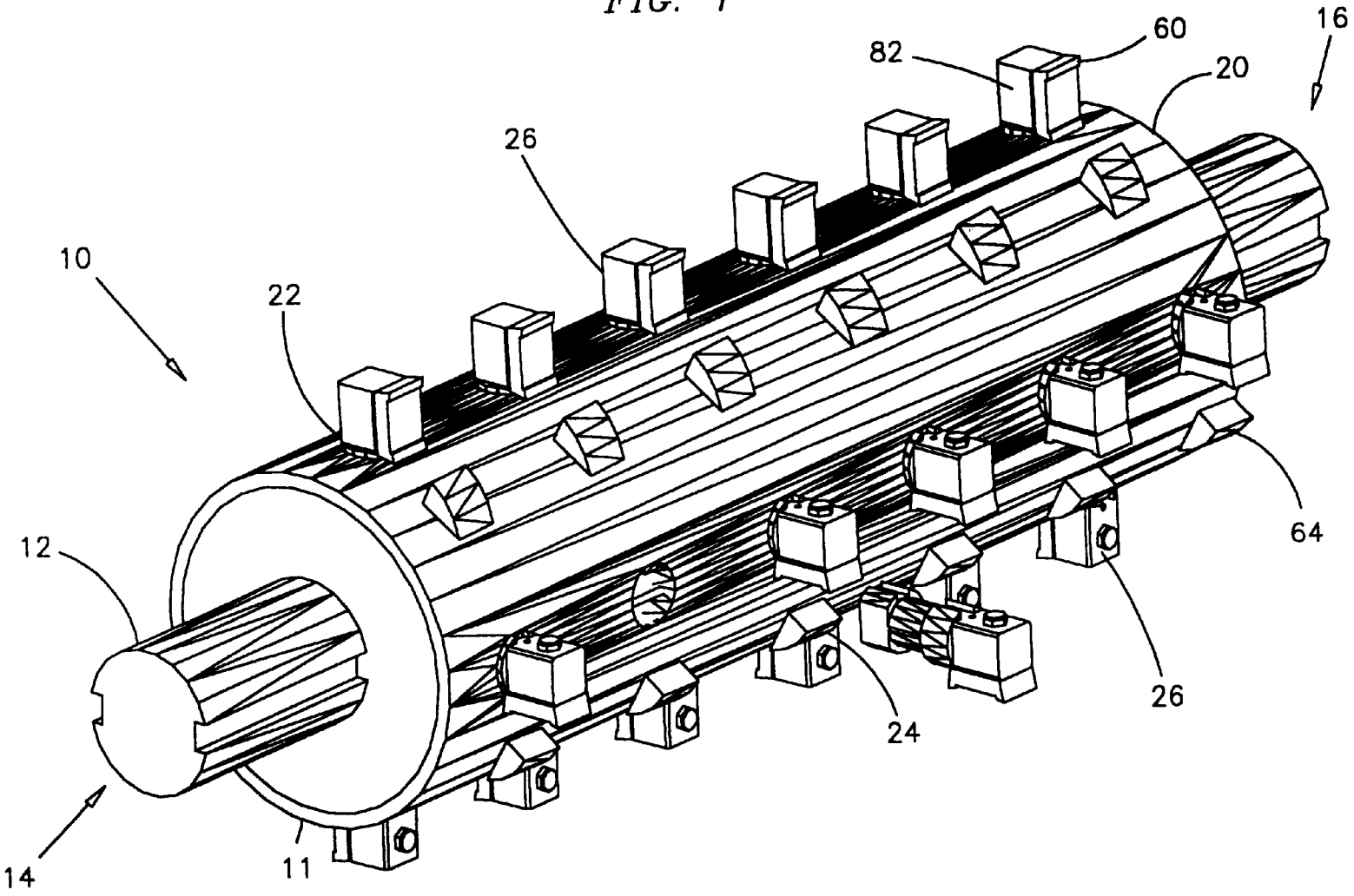
FIG. 1 is a perspective view of a rotor assembly.

By contrast, FIG. 1 shows a rotor assembly 10 of the present invention. The rotor assembly 10 comprises a central shaft 12, a webbing 18 (best shown in FIG. 2), a rotor casing 20, a plurality of hammers 26, and a plurality of sockets 22. The central shaft 12 comprises a drive end 14 capable of securement to a drive motor (not shown) of a size reducing machine 56 (shown in FIG. 3), and an outboard end 16 lying at the opposite end of the rotor assembly 102 from the drive end 14. The central shaft 12 also comprises a key 11 for securement and rotation of the webbing 18. The rotor casing 20 comprises a plurality of throughbores 24 for securement of the upper end 54 of the sockets 22 via welds, and protects the webbing from contact with debris. The sockets 22, and the hammers 26 configure for releasably securement. Furthermore, the rotor assembly 10 comprises a plurality of production pockets 64 to deflect debris away from the lower edge of the hammer tips 60, and toward the primary impact surface of the upper edge of the hammer tips 60.

In contrast to the prior art rotor assemblies 100, the rotor casing 20 of the rotor assembly 10 provides protection to the webbing 18, and the hammers 26 easily secure and release for quick individual replacement that does not involve disassembly and reassemble of the rotor assembly 10. By protecting the webbing 18 from contact with the debris, the rotor assembly 10 experiences less wear and tear, maintains good alignment, and better directs the debris toward the hammer tips 60. The rotor assembly 10 allows for more effective operation by preventing the loss of power associated with debris striking the webbing 16, and maximizes debris contact with the hammer tips 60. The hammer tips 60 comprises the primary surface designed to size reduce the matter placed in the size reducing machine.

Figure 2:
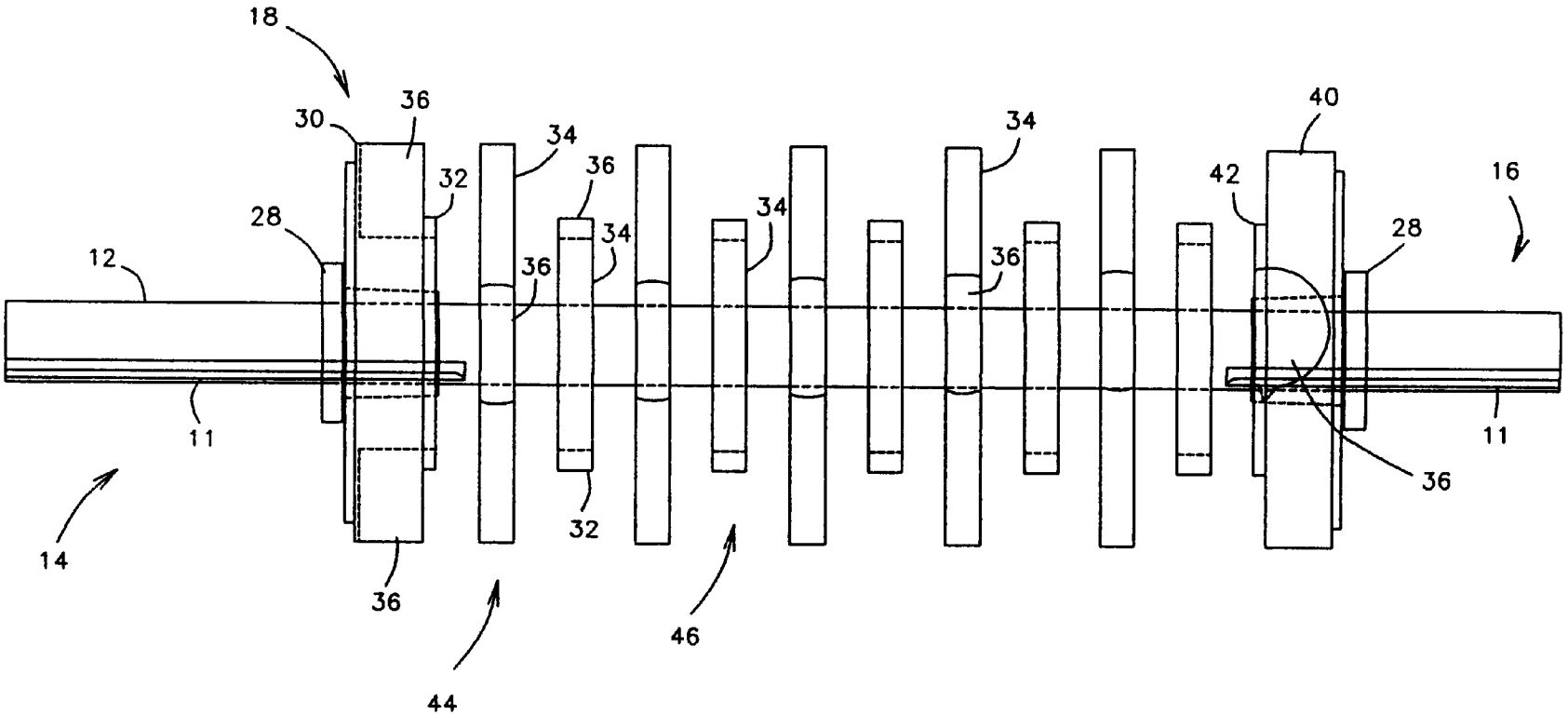
FIG. 2 is a side elevation view of a central shaft and webbing of the rotor assembly of FIG. 1.
Figure 6C:
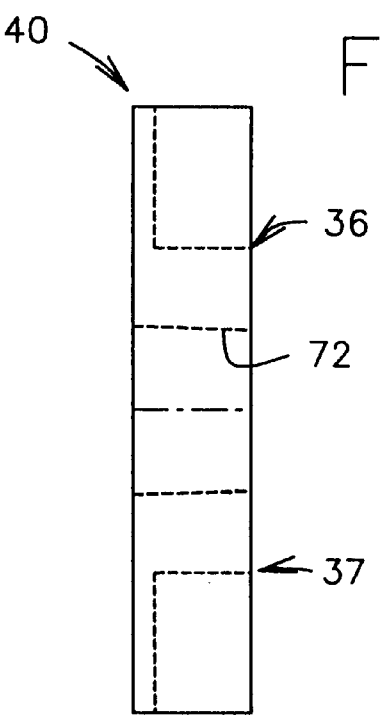
FIG. 6*c* is a side elevation view of the outboard end plate of FIG. 6*a*.
Figure 6A:
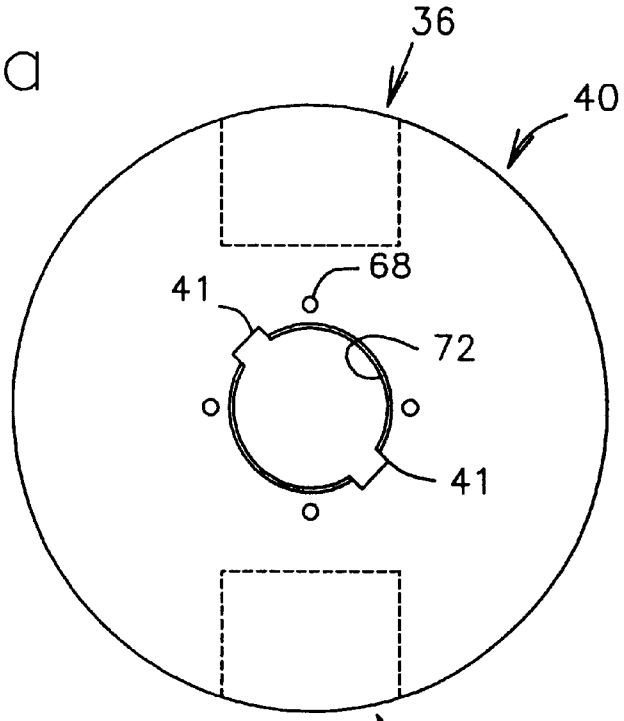
FIG. 6*a* is a top plan view of an outboard end plate of the rotor assembly of FIG. 1.
Figure 6B:
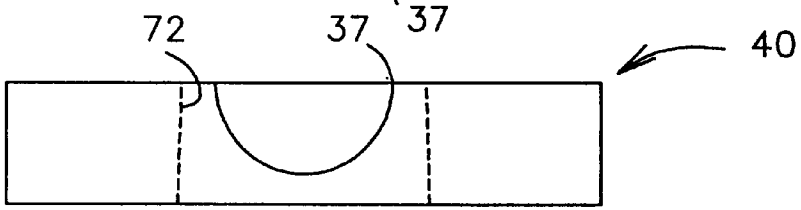
FIG. 6*b* is a side elevation view of the outboard end plate of FIG. 6*a*.
Figure 7C:
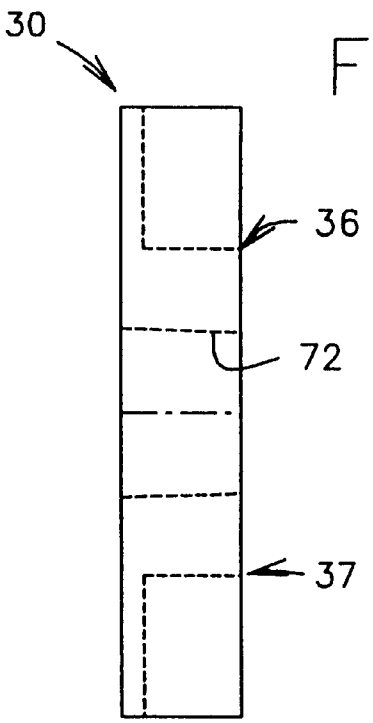
FIG. 7*c* is a side elevation view of the drive end plate of FIG. 7*a*.
Figure 7A:
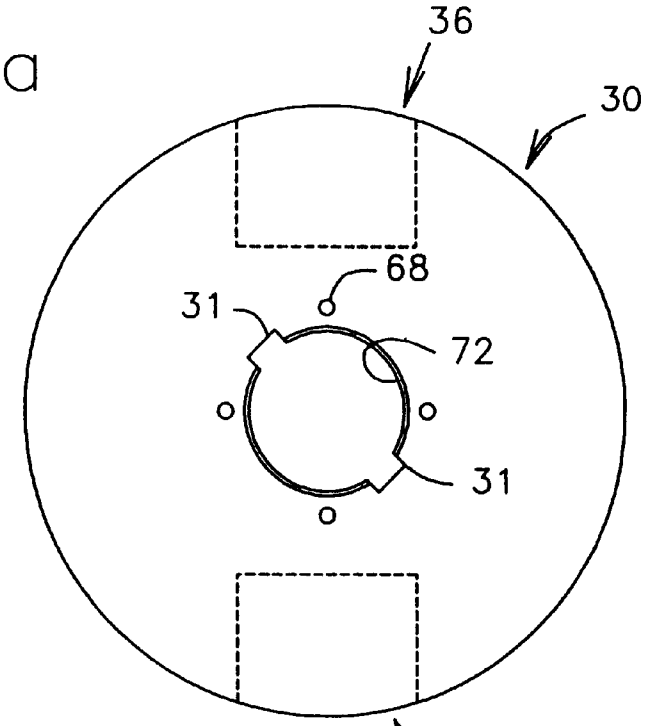
FIG. 7*a* is a top plan view of a drive end plate of the rotor assembly of FIG. 1.
Figure 7B:
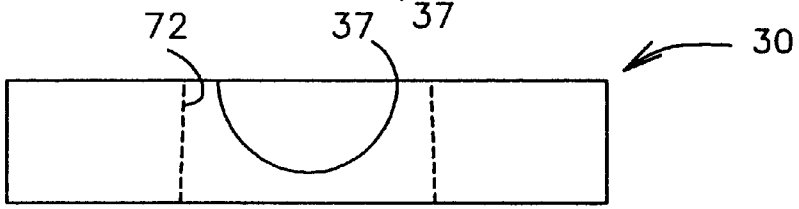
FIG. 7*b* is a side elevation view of the drive end plate of FIG.

FIG. 2 shows a detailed view of the webbing 18, a drive end plate 30, and an outboard end plate 40. The webbing 18 further comprises a plurality of web socket supports 34. The drive end plate 30 and the outboard end plate 40 secure to the central shaft 12 via the central shaft key 11. FIGS. 6*a–c* show the outboard end plate 40, while FIGS. 7*a–c* show the drive end plate 30. Both the drive end plate 30 and the outboard end plate 40 contain a central shaft throughbore 72. Adjacent to the central shaft throughbore 72 are keyways 31, 41. The keyways 31, 41 fit over the central shaft key 11. Thus, the central shaft key 11 provides for the rotation of the drive end plate 30 and the outboard end plate 40 through contact with the keyways 31, 41. In the preferred embodiment of the present invention, the location of the keyway 31 of the drive end plate 30 differs from the location of the keyway 41 of the outboard end plate 40, as explained infra. The central shaft throughbore 72 is clearanced to the central shaft 12. In other words, the diameter of the central shaft throughbore 72 of the drive end plate 30 and the outboard end plate 40, exceeds the diameter of the central shaft 12 by a slight amount. This allows for removal of the central shaft 12 in the case of repairs. Split tapered bushings 28 secure the drive end plate 30 and the outboard end plate 40 to the central shaft 12. The split tapered bushings 28 draw down over the drive end plate 30 and the outboard end plate 40 with threaded bolts (not shown). The threaded bolts thread into threaded throughbores 68 in the drive end plate 30 and the outboard end plate 40.

Moreover, the drive end plate 30 and the outboard end plate 40 secure to the rotor casing 20 through welds. The drive end plate 30 and the outboard end plate 40 substantially seal the rotor assembly 10. Encasing the rotor assembly 10 in this manner, provides additional protection for the web socket supports 34. Additionally, the smooth surface of the rotor casing 20 provides a means to deflect any residual debris away from non-impact surfaces. This prevents consumption of excess power, prevents wear and tear of the non-impact surfaces, and ensures that the hammer tips 60 perform the size reducing.

Figure 3:
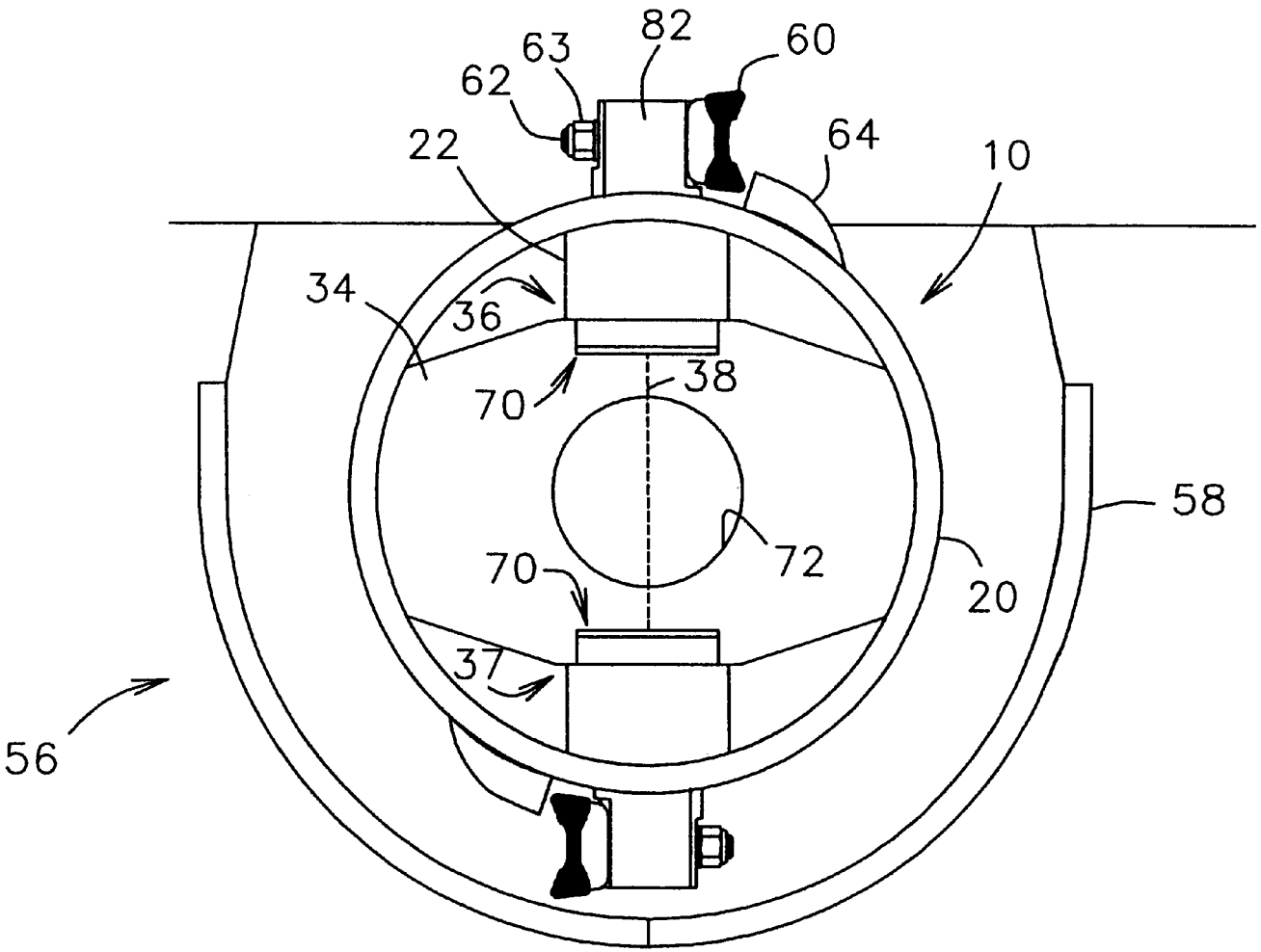
FIG. 3 is a cross-sectional view of the rotor assembly of FIG. 1 within a size reducing machine.
Figure 9B:
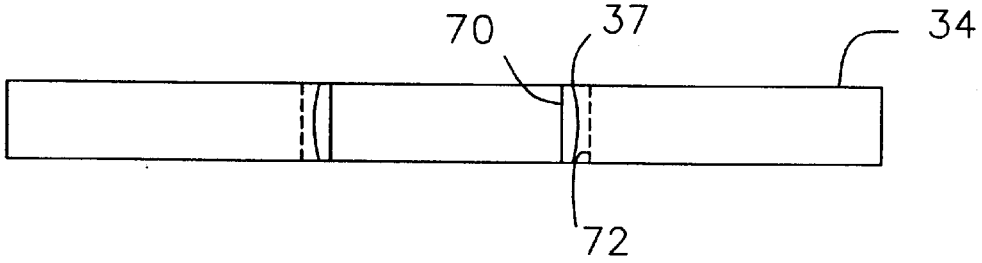
FIG. 9*b* is a side elevation view of the web socket support of FIG. 9*a*.
Figure 9A:
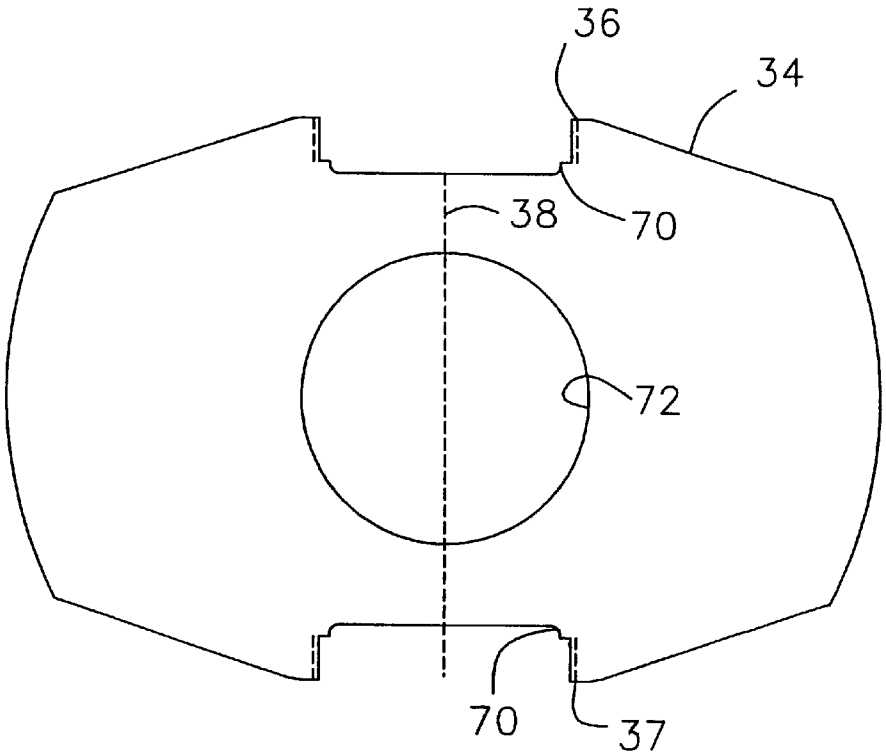
FIG. 9*a* is a top plan view of a web socket support of the rotor assembly of FIG. 1.

The plurality of web socket supports 34 of the webbing 18 orient between the drive end plate 30 and the outboard end plate 40. The web socket supports 34 further comprise socket receiver channels, and in particular each web socket support 34 contains a first socket receiver channel 36 and a second socket receiver channel 37. FIGS. 9*a–b* show that the first and second socket receiver channels 36, 37 align at opposite ends of a receiver channel axis 38 of the web socket supports 34. The socket receiver channels 36, 37 of the web socket supports 34 are rounded for receipt of the lower end 55 of the sockets 22. FIG. 9*b* shows that the socket receiver channel 37 receives the socket 22 at its widest point, thereby aligning and capturing the sockets 22. Additionally, the socket receiver channels 36, 37 lie over a square channel 70. FIG. 3 shows that the square channel 70 allows for a gap between the lower end 55 of the socket 22 and the square channel 70, since the diameter of the socket 22 exceeds the width of the square channel 70. This allows for easier removal of the socket 22, in the case where such a repair becomes necessary.

Figure 8B:
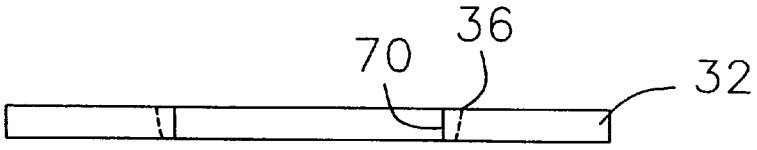
FIG. 8*b* is a side elevation view of the socket support of FIG. 8*a*.
Figure 8A:
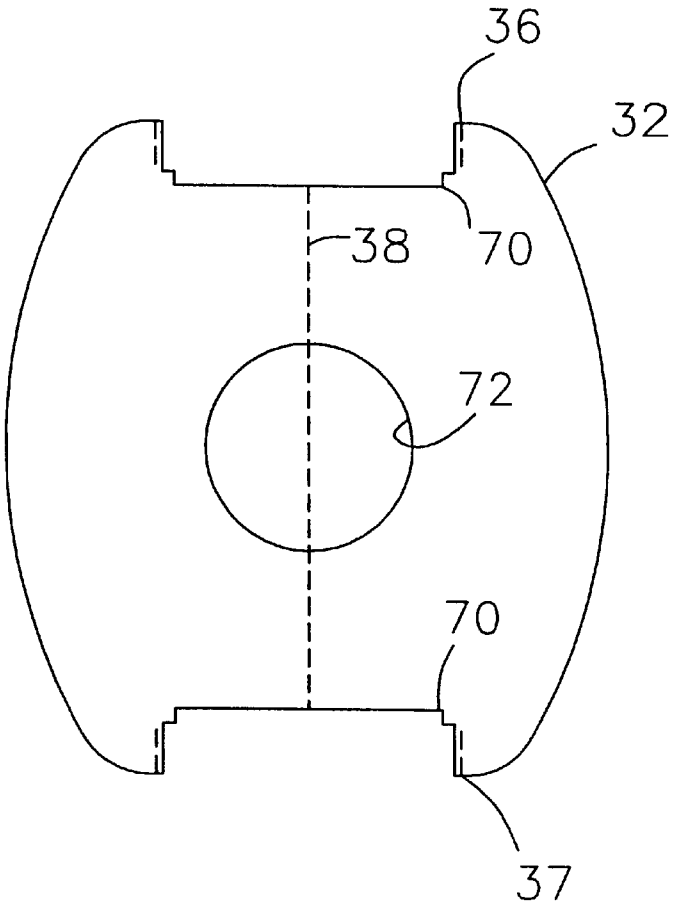
FIG. 8*a* is a top plan view of a socket support of the rotor assembly of FIG. 1.

FIG. 2 shows a specialized type of web socket supports, namely a drive end socket support 32 secured to the drive end plate 30, and an outboard end socket support 42 secured to the outboard end plate 30. Welds secure the drive end socket support 32 to the drive end plate 30, and secure the outboard end socket support 42 to the outboard end plate 40. FIGS. 8*a–b* show that the first and second receiver channels 36, 37 of the drive end socket 32 (identical to the outboard end socket support 42) complete the curvature necessary to capture and align the sockets 22. Viewing the first receiver channel 36 of the outboard end plate 40, shown best in FIG. 2, reveals that the curvature of the receiver channel 36 only encloses approximately 180° of the perimeter of the socket 22. Accordingly, the outboard end plate 40 cannot capture the socket 22. Therefore, inclusion of the outboard end socket support 42, and the drive end socket support 32, allows for capture and alignment of the sockets 22, by enclosing more than 180° of the perimeter of the socket 22.

FIG. 2 also shows that the web socket supports 34 configure in a first row 44 and a second row 46. In other words, every web socket support 34 aligns transversely to the adjacent web socket support 34. This forms four rows of socket receiver channels, shown best in FIG. 5, the first row of web socket supports 44 forms a first row 48 and a forth row (not shown) of socket receiver channels 36, 37. Likewise, the second row of web socket supports 46 forms a second row 50 and third row 52 of socket receiver channels 36, 37.

Figure 5:
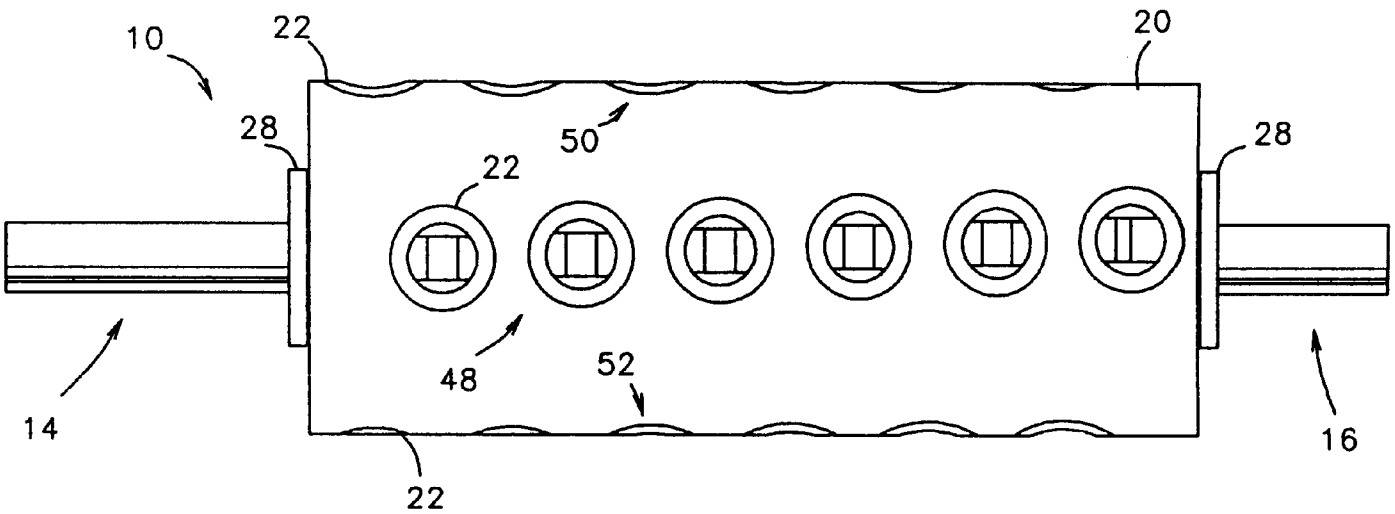
FIG. 5 is a side elevation view of a rotor assembly of FIG. 1 with the hammers removed.

FIG. 5 shows a shift between the first and second rows of web socket supports 44, 46. In other words, the first socket 22 of the first row of web socket supports 44 is laterally shifted toward the outboard end 16 of the central shaft 12, relative to the first socket 22 of the second row of web socket supports 46. This accounts for the fact that FIG. 2 shows a first socket receiver channel 36 in the outboard end plate 40, while the drive end plate 30 shows no corresponding structure. The drive end plate 30 comprises a first and second socket receiver channels 36,37 (shown in phantom), however the first and second socket receiver channels 36,37 of drive end plate 30 are rotated approximately 90° relative to the first and second socket receiver channels 36,37 of the outboard end plate 40.

Figure 4:
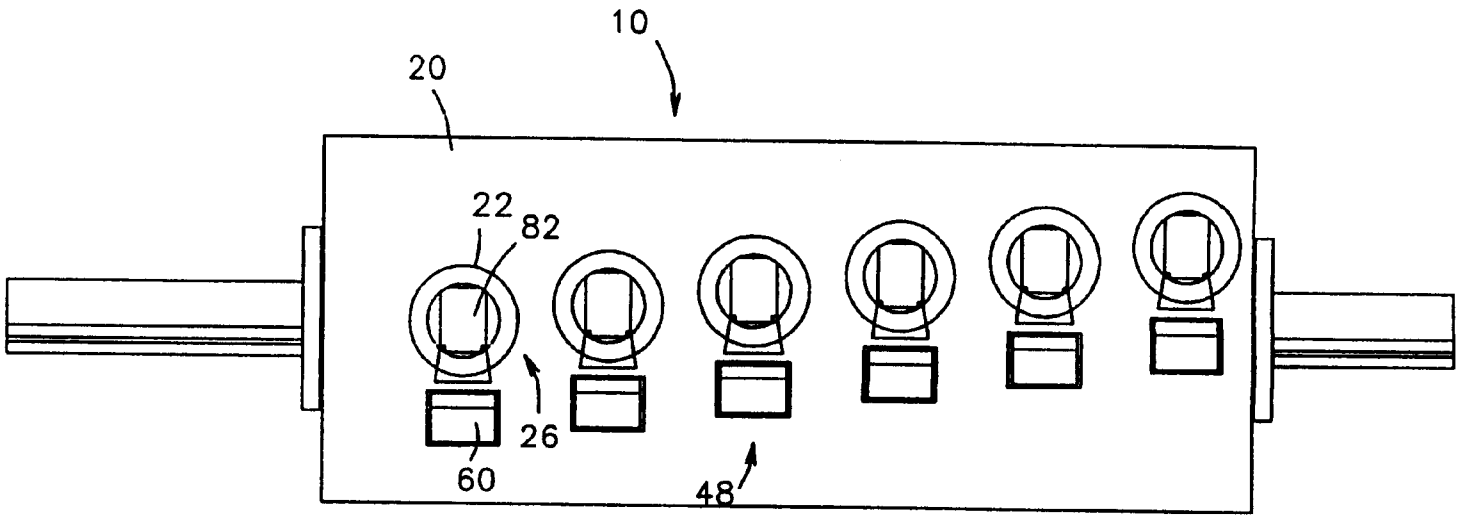
FIG. 4 is a side elevation view of a staggered row of hammers of the rotor assembly of FIG. 1.

FIG. 5 also shows that the first and second rows of web socket supports 44,46, and therefore the four rows of socket receiver channels 48,50,52, (fourth row not shown), align substantially parallel to the central shaft 12. In particular, the four rows of socket receiver channels 48,50,52, (4th row not shown), are transversely staggered relative to the central shaft 12. Best shown in FIG. 4, the first row of socket receiver channels 48 vary in position along the central shaft 12. This allows each hammer that releasably secures to a socket 22, which is captured and aligned by the first row of socket receiver channels 48, to individually strike debris being size reduced. The prior art rotor assembly 102, by contrast, requires all of the plurality of hammers 118 in a row to strike the debris simultaneously. The prior art method requires a greater amount power, thereby transferring a greater shock load through the rotor assembly 102. Of course, the greater the shock load the greater the chances of damage to the rotor assembly 102 resulting in the aforementioned alignment problems. Those of ordinary skill in the art will realize that the present invention contemplates various arrangements and configurations of transverse staggers of the socket receiver channels. For example, the transverse stagger could be v-shaped, or a sawtooth pattern, or the like. Additionally, the stagger accounts for the different orientation of the keyways 31, 41 of the drive end plate 30 and the outboard end plate 40, relative to the first and second receiver channels 36, 37 (shown in phantom in FIGS. 6*a–c*, and FIGS. 7*a–c* respectively). Varying the location of the socket receiver channels 36, 37 within the web socket supports 34, allows for easily altering the configuration and arrangement of hammers 26.

Figure 10:
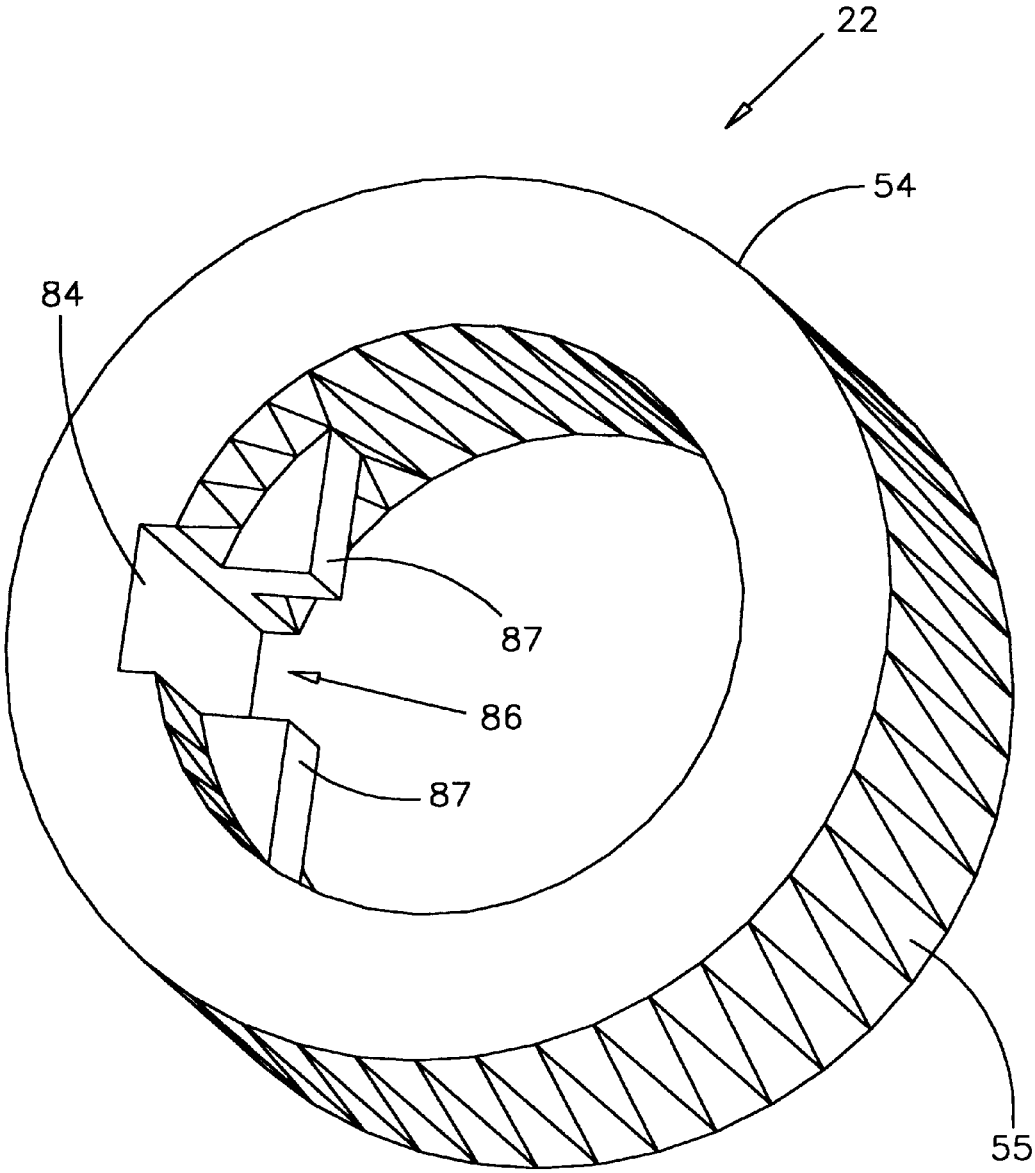
FIG. 10 is a perspective view of a socket of the rotor assembly of FIG. 1.
Figure 11:
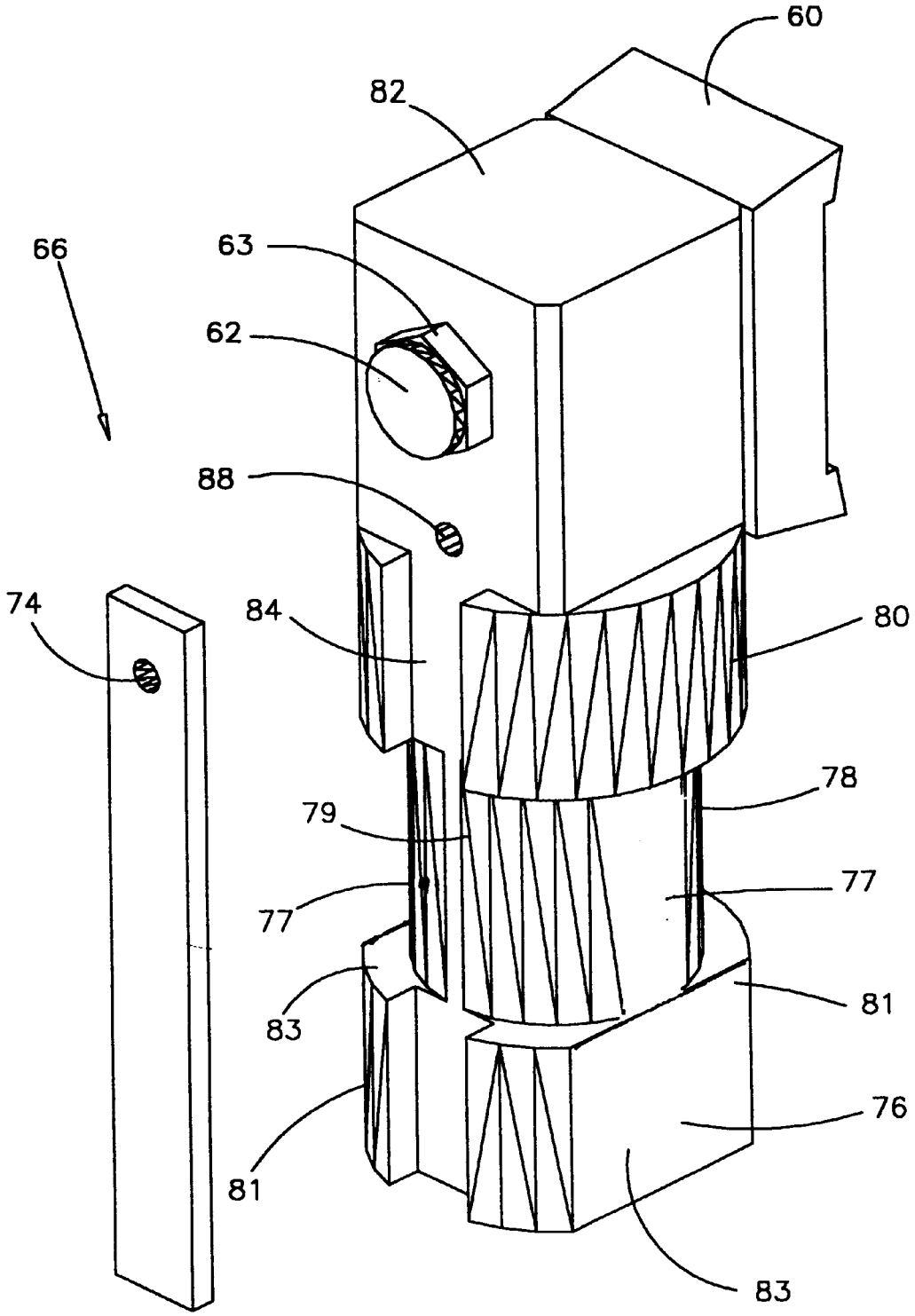
FIG. 11 is a perspective view of a hammer of the rotor assembly of FIG. 1.

FIG. 11 shows a perspective view of a hammer 26. The hammer 26 comprises a first section 76, a second section 78, an third section 80, and an upper hammer body 82. Further, the hammer 26 also comprises a hammer tip 60 secured to the upper hammer body 82 with a bolt 62 and nut 63. The hammer 26 also comprises a keyway 84 along an exterior wall of the hammer 26, and a key bolt throughbore 88. The hammer 26 is designed for releasably securement with the socket 22 shown in FIGS. 13*a–d* (see also FIG. 10). The hammer 26 moves vertically within the socket 22, when oriented in a position that allows the first section 76 of the hammer 26 to move freely past a hammer stop 86 of socket 22. The first section 76 of the hammer 26 has two diametrically opposed curved sides 81, and two flat faced diametrically opposed sides 83. The curved sides 81 of the first section 76 of the hammer 26 fit within the inner diameter of the socket 22, and the flat faced sides 83 of the first section 76 of the hammer 26 fit between the diametrically opposed hammer stops 86 of the socket 22. Thus, oriented in this manner the first section 76 of the hammer 26 moves vertically past the hammer stops 86 of the socket 22.

Figures 12A, 12B, 12C, 12D:
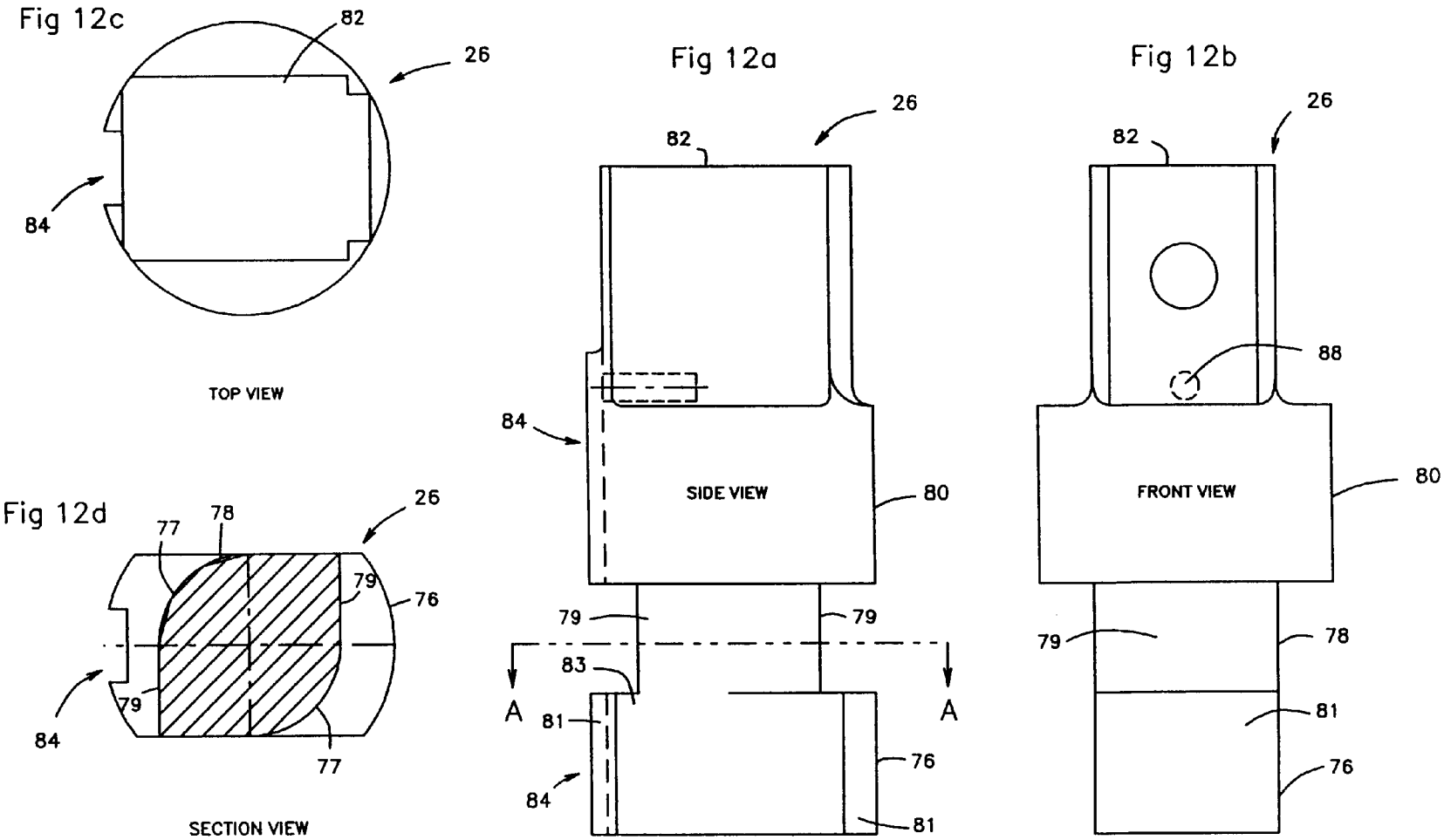
FIG. 12*a* is a side elevation view of a hammer of the rotor assembly of FIG. 1.
FIG. 12*b* is a front elevation view of the hammer of FIG. 12*a*.
FIG. 12*c* is a top plan view of the hammer of FIG. 12*a*.
FIG. 12*d* is a top cross-sectional view of the hammer of FIG. 12*a* along the line A.
Figure 13C:
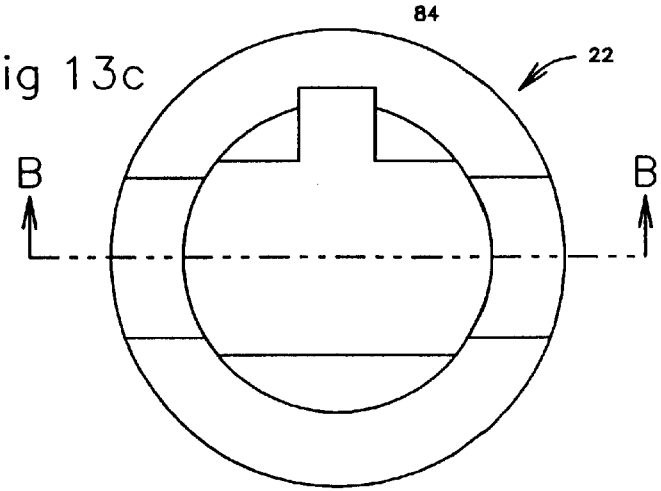
FIG. 13*c* is a top plan view of the socket of FIG. 13*a* rotated 90°.
Figure 13D:
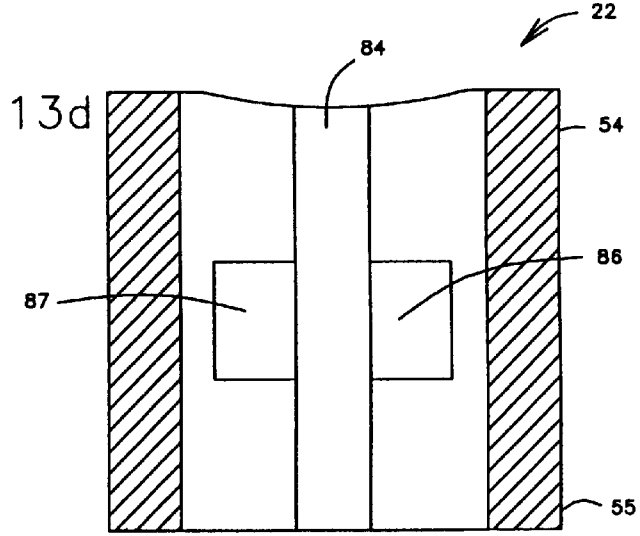
FIG. 13*d* is a cross-sectional view of the socket of FIG. 13*c* along the line B.
Figure 13A:
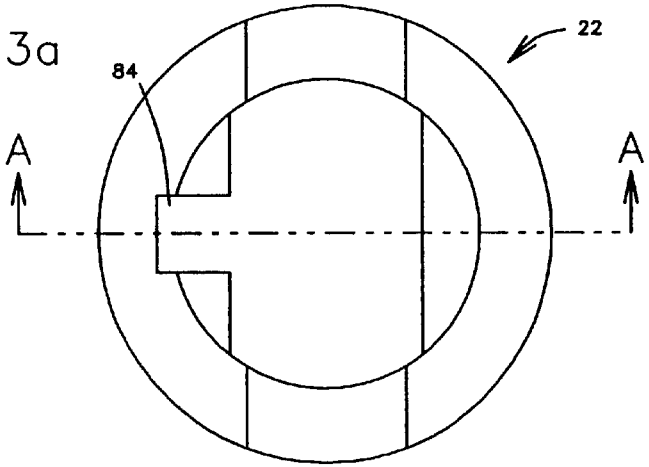
FIG. 13*a* is a top plan view of a socket of the rotor assembly of FIG. 1.
Figure 13B:
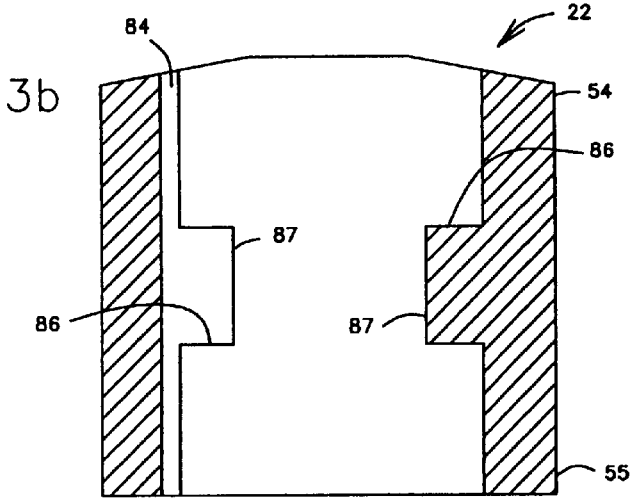
FIG. 13*b* is a cross-sectional view of the socket of FIG. 13*a* along the line A.
Figure 14B:
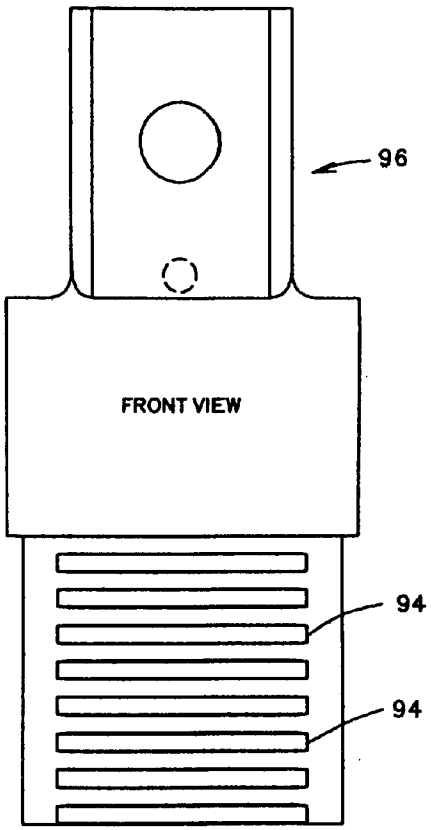
FIG. 14*b* is a side elevation view of the hammer of FIG. 14*a* rotated 90°.
Figure 14A:
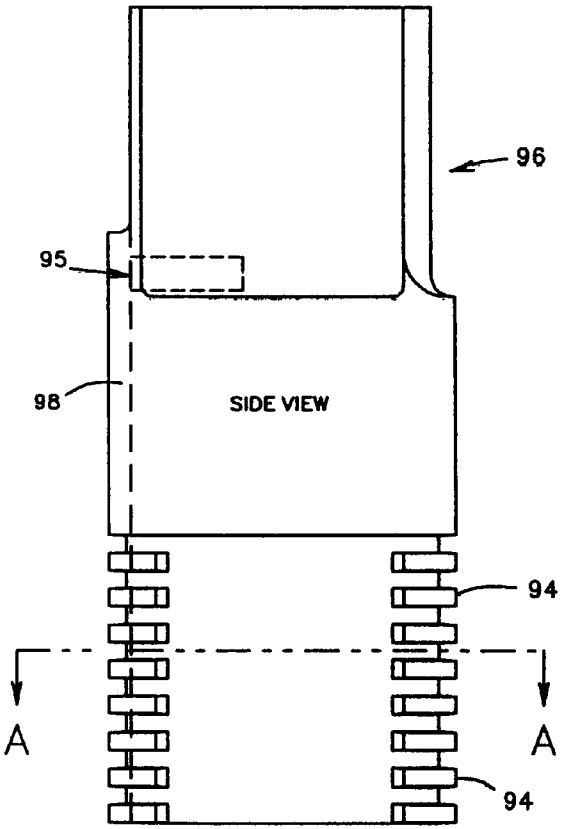
FIG. 14*a* is side elevation view of an alternative hammer.
Figure 14C:
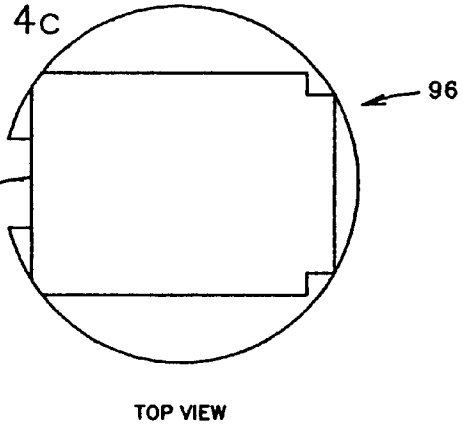
FIG. 14*c* is top plan view of the alternative hammer of FIG. 14*a*.
Figure 14D:
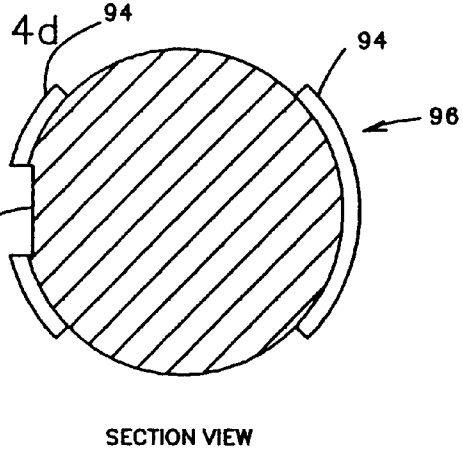
FIG. 14*d* is a top cross-sectional view of the alternative hammer of FIG. 14*a* along the line A.
Figure 15C:
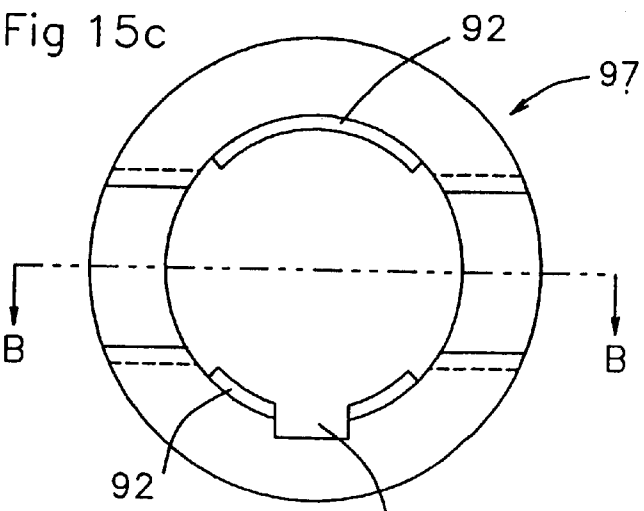
FIG. 15*c* is a top plan view of the alternative socket of FIG. 15*a* rotated 90°.
Figure 15D:
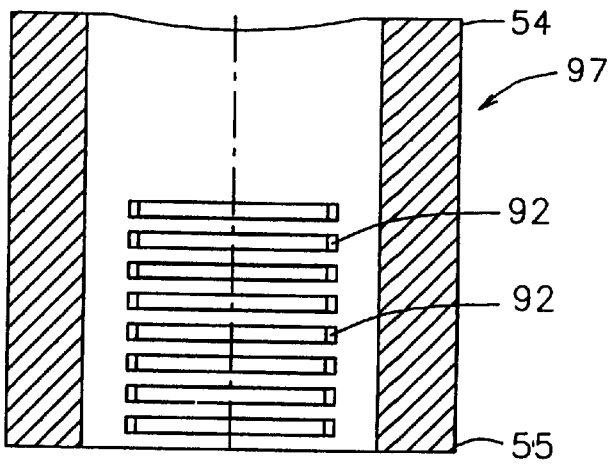
FIG. 15*d* is a cross-section view of the alternative socket of FIG. 15*b* rotated 90° along the line B.
Figure 15A:
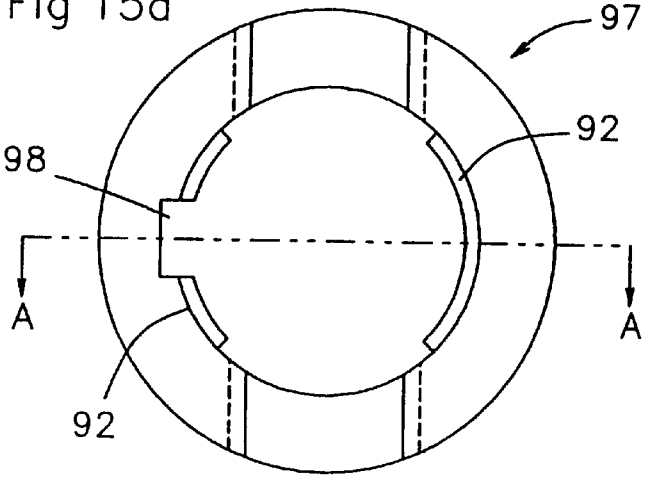
FIG. 15*a* is a top plan view of an alternative socket.
Figure 15B:
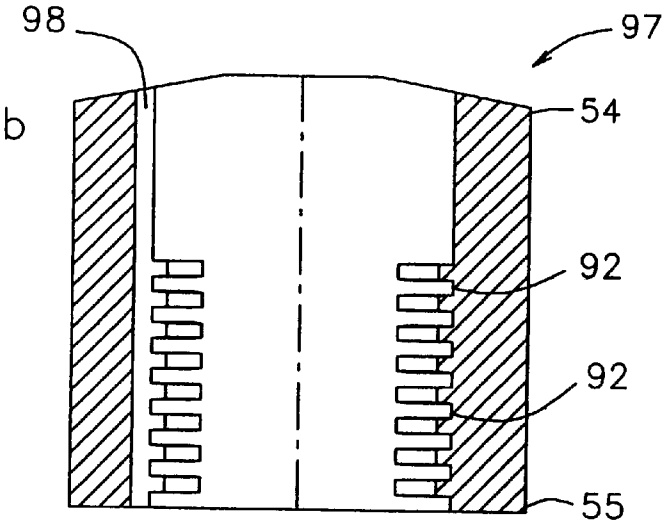
FIG. 15*b* is a cross-section view of the alternative socket of FIG. 15*a* along the line A.

The hammer 26 secures to socket 22 by first inserting the first section 76 of the hammer 26 past the hammer stops 86, in the aforementioned manner. Then rotating the hammer 26 within the socket 22 captures the hammer stops 86 of the socket 22 between the first section 76, the second section 78, and the third section 80. In other words, rotating the hammer 26 places the curved sides 81 of the first section 76 of the hammer 26 under the hammer stops 86. In this position, the hammer cannot move vertically within the socket 22. The rotation stops when the flat faced sides 79 of the second section 78 of the hammer 26 contact the vertical sides 87 of the hammer stops 86. FIG. 12*d* shows that the second section 78 of the hammer 26 includes two diametrically opposed curved sides 77 that allow the hammer 26 to rotate. However, after approximately 90° of rotation the flat faced sides 79 of the second section 76 of the hammer 26 contact the vertical sides 87 of the hammer stops 86 of the socket 22. Oriented in this position the keyways 84 of the socket 22 and the hammer 26 align to allow insertion of a key 66. The keyway 84 of the socket 22 is located along an interior wall of the socket 22. The key 66, upon insertion, prevents rotation of the hammer 26 within the socket 22. The key 66 secures via a bolt (not shown) inserted through the key throughbore 74 and a threaded key bolt throughbore 88 located in the upper hammer body 82.

FIGS. 14*a–d*, and FIGS. 15*a–d* show an alternative embodiment of a hammer 96 and socket 97. In this embodiment, the hammer 96 comprises a hammer thread 94 extending partially around the outer diameter of the hammer 96. Correspondingly, the socket 97 also contains a partially extending socket thread 92, which extends partially around the inner diameter of the socket 97. Thus, the hammer 96 releases from the socket 97, thereby moving freely in a vertical direction, when the hammer 96 is oriented in a position such that the hammer threads 94 and the socket threads 92 do not interconnect. Securing the hammer 96 within the socket 97 involves inserting the hammer 96 within the socket 97 in the aforementioned manner. Then, by rotating the hammer 96 within the socket 97 the hammer threads 94 and the socket threads 92 interlock thereby preventing the hammer 96 from moving in the vertical direction. Additionally, the hammer 96 and the socket 97 comprise keyways 98, which when aligned allow for insertion of a key 66 that prevents rotation of the hammer 96 within the socket 97 in the same manner described above.

Figure 17A:
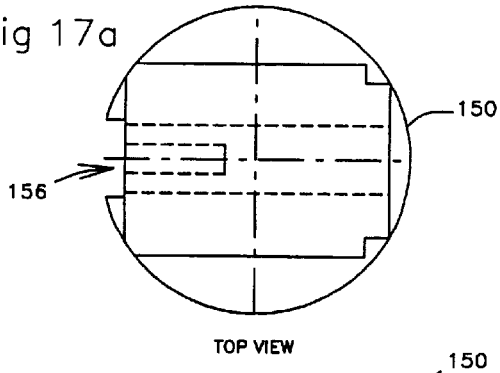
FIG. 17*a* is a top plan view of another alternative hammer.
Figure 17B:
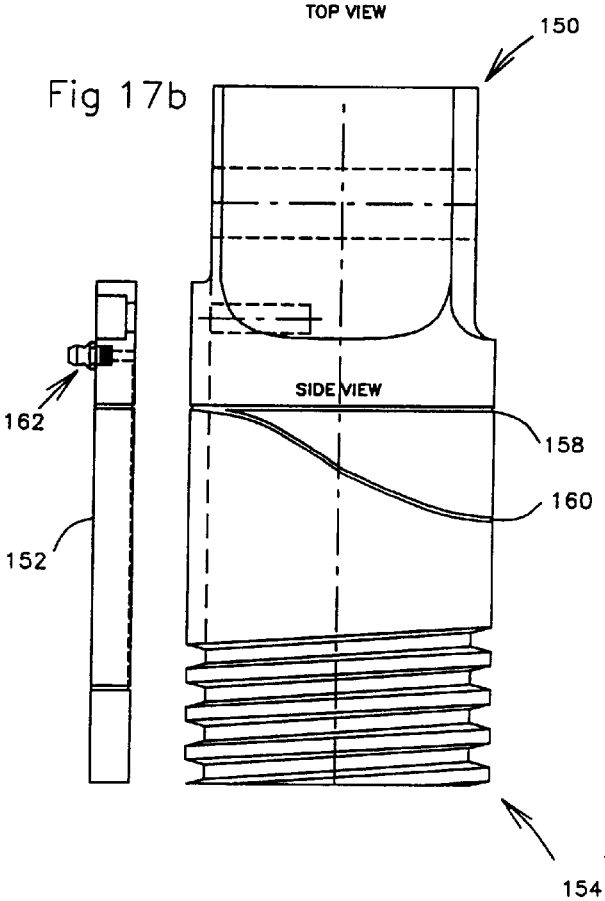
FIG. 17*b* is a side elevation view of the alternative hammer of FIG. 17*a*.
Figure 17C:
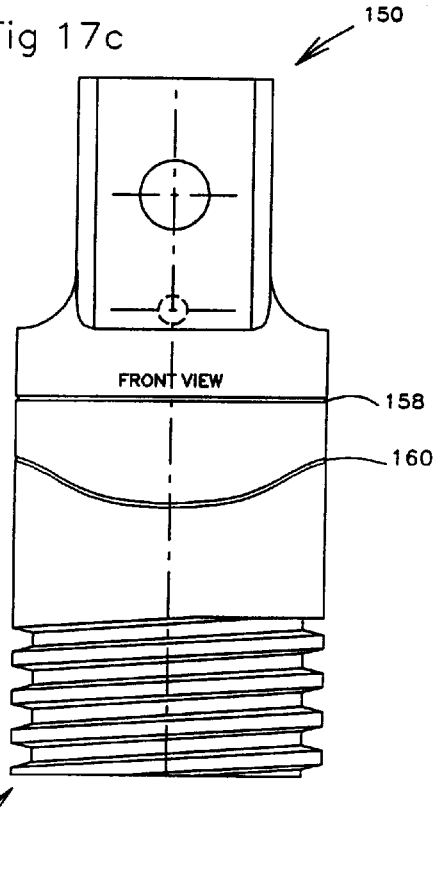
FIG. 17*c* is a front elevation view of the alternative hammer of FIG. 17*a*.

FIGS. 17*a–c*, show an alternative embodiment of a hammer 150. In this embodiment, the hammer 150 includes a keyway 156 and a key 152. The key 152 and keyway 156 combine in a manner identical to that described above, wherein after the hammer 150 is releasably secured within the socket, insertion of the key 152 locks the hammer 150 into place. The hammer 150 also comprises a socket thread 154 which completely encircles a lower portion of the hammer 150. The socket thread 154 is designed for releasable securement with an interior socket thread of a socket. The socket compatible with the hammer 150 is essentially the same as the socket 97 of FIGS. 15*a–c*. The interior socket thread is essentially identical to the partially extending socket thread 92 of the socket 97, except that the interior socket thread completely encircles the interior of the socket 97. In this manner, the hammers 150 releasably secure to the plurality of sockets 97 (with the modified interior socket thread) through threaded engagement.

The hammer 150 also comprises a first lubrication thread 158 and a second lubrication thread 160. The lubrication threads 158, 160 align with a lubrication aperture 162 in key 152 to allow for periodic insertion of lubricant. The first lubrication thread 158 is positioned to provide at least a partial seal between the hammer 158 and the socket 97 (modified). This seal provides protection from residual debris generated during the operation of machine from wedging between the hammer 158 and the socket 97 (modified). Debris lodged between the hammer 150 and the socket 97 (modified) creates difficulty in removing the hammer 150 from the socket. The second lubrication thread 160 provides for lubrication of the hammer socket thread 154. Lubricant can travel from the lubrication aperture 162 down the second lubrication thread 160, to the socket thread 154 of the hammer 150. Periodic insertion of lubricant facilitates removal of the hammer 150 from within the socket 97 (modified).

Figure 18:
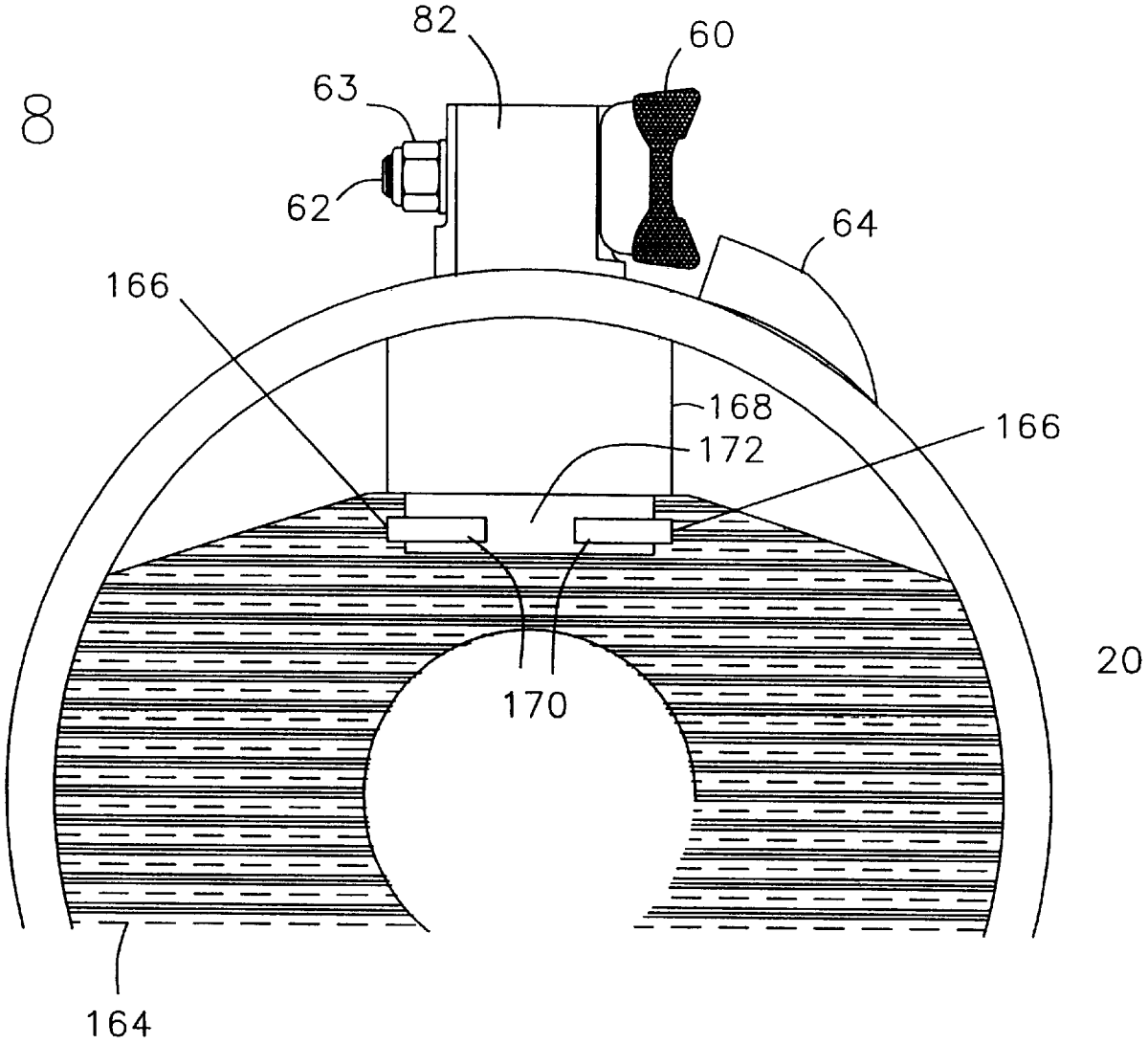
FIG. 18 is a partial cross-sectional view of the rotor assembly with an alternative socket and web socket support design.

FIG. 18 shows an alternative embodiment of an interlocking design for a socket 168 and a web socket support 164. In this embodiment the socket 168 contains a nearly annular socket lock ring 170. The socket lock ring 170 extends around the perimeter of the socket 168 except for two opposing gaps 172 (only one shown). The gaps 172 are sufficiently wide to allow for removal of the socket 168 from the web socket support 164. In other words, rotating the socket 168 from the position shown FIG. 18 will align the gaps 172 so that the socket 168 can be removed by lifting the socket 168 vertically upwards from the position shown a FIG. 18. Upon insertion of the socket 168 within the web socket support 164, and by rotating the socket 160 to secure the socket lock ring 170 within the web socket receiver rings 166, will secure the socket 168 in place. In the unlikely event that the welds that secure the socket 168 to the rotor casing 20 break, the design of the socket 168 and a web socket support 164 will provide additional protection against the socket 168 dislodging from the web socket support 164.

By providing for releasable securement of the hammers 26, 96 within the sockets 22, 97, the present invention allows for rapid and efficient replacement of the hammers 26, 96, unlike the prior art rotor assembly 102. The present invention eliminates, and/or reduces the frequency of, the troublesome and time consuming problems associated with removing the pins 112 and then realigning the rotor assembly 102.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing form the scope of the invention.

I claim:

1. A rotor assembly for a size reducing machine having a drive motor, said rotor assembly comprising:

a) a central shaft for rotating said rotor assembly having a drive end capable of securement to the drive motor of the size reducing machine, and an outboard end opposite to said drive end;

b) a webbing engaged with said central shaft for supporting said rotor assembly, said webbing comprising a plurality of web socket supports engaged at a first end with said central shaft, wherein each of said plurality of web socket supports further comprise a socket receiver channel at a second end;

c) a rotor casing engaged with and surrounding said webbing for protecting said webbing;

d) a plurality of sockets comprising:

i) an upper end secured to a plurality of throughbores located in said rotor casing;

ii) a lower end for alignment with, and capture by, said socket receiver channels of said web socket supports of said webbing;

iii) an interior socket thread; and e) a plurality of hammers releasebly secured to said plurality of sockets through threaded engagement between a hammer socket thread of said plurality of hammers and said interior socket threads of said plurality of sockets.

2. The invention in accordance with claim 1 wherein said plurality of sockets further comprise a plurality of keyways along an interior side wall of each of said plurality of sockets, and said plurality of hammers further comprise a plurality of keyways along an exterior side wall of each of said plurality of hammers, wherein when said hammers are secured to said plurality of sockets said keyways align to allow insertion of a plurality of keys to lock said hammers in place within said sockets.

3. The invention in accordance with claim 2 wherein said plurality of hammers comprise a lubrication thread, and said plurality of keys comprise a lubrication aperture aligned to said lubrication thread of said plurality of hammers, wherein inserting lubricant through said lubrication aperture and into said lubrication thread provides for easier release of said plurality of hammers from within said plurality of sockets.

4. The invention in accordance with claim 3 further comprising a first lubrication thread and a second lubrication thread aligned to said lubrication aperture of said plurality of keys, such that the application of a lubricant into said lubrication aperture and into said first lubrication thread at least partially seals said plurality of hammers and said plurality of sockets, and the application of a lubricant into said lubrication aperture and into said second lubrication thread lubricates said interior socket thread of said plurality of sockets and said socket thread of said plurality of hammers.

5. The invention in accordance with claim 1 further comprising a drive end plate secured to said drive end of said central shaft and an outboard end plate secured to said outboard end of said central shaft, wherein said end plates are also secured to said rotor casing for substantially sealing said rotor assembly.

6. The invention in accordance with claim 5 wherein said drive end plate and said outboard end plate are secured to said central shaft with bushings.

7. The invention in accordance with claim 5 wherein said plurality of web socket supports further comprise a drive end socket support secured to said drive end plate, and an outboard end socket support secured to said outboard end plate.

8. The invention in accordance with claim 5 wherein said plurality of web socket supports further comprise a first and a second socket receiver channel for receipt of said plurality of sockets, wherein said first and second socket receiver channels are oppositely aligned along a receiver channel axis of said web socket supports.

9. The invention in accordance with claim 8 further comprising a first row of web socket supports and a second row of web socket supports transversely aligned to said first row of web socket supports, thereby forming four rows of socket receiver channels.

10. The invention in accordance with claim 9 wherein said first and second rows web socket supports are laterally shifted from each in a direction parallel to said central shaft.

11. The invention in accordance with claim 9 wherein said four rows of socket receiver channels are aligned substantially parallel to said central shaft.

12. The invention in accordance with claim 9 wherein said four rows of socket receiver channels are transversely staggered relative to said central shaft.

13. The invention in accordance with claim 1 wherein said plurality of sockets further comprise a socket lock ring and said plurality of web socket supports further comprise a web socket receiver ring for receipt of said socket lock rings thereby securing said plurality of sockets to said plurality of web socket supports.

14. The invention in accordance with claim 13 wherein said plurality of sockets further comprises two opposing gaps in said socket lock ring to allow for removable securement of said plurality of sockets to said plurality of web socket supports, wherein said plurality of sockets release from said plurality of web socket supports by rotating said plurality of sockets to align said opposing gaps with said web socket receiver ring of said plurality of web socket supports, and said plurality of sockets secure to said plurality of web socket supports by rotating said plurality of sockets such that said socket lock rings of said plurality of sockets are received within said web socket receiver ring of said plurality of web socket supports.

15. A rotor assembly for a size reducing machine having a drive motor, said rotor assembly comprising:

a) a central shaft for rotating said rotor assembly having a drive end capable of securement to the drive motor of the size reducing machine, and an outboard end opposite to said drive end;

b) a drive end plate secured to the drive end of said central shaft with a bushing, for substantially sealing said drive end of said rotor assembly;

c) an outboard end plate secured to said outboard end of said central shaft with a bushing, for substantially sealing said outboard end of said rotor assembly;

d) a webbing engaged with said central shaft for supporting said rotor assembly, said webbing comprising a plurality of web socket supports located between said drive end plate and said outboard end plate, wherein said plurality of web socket supports further comprise a first and a second socket receiver channel having a web socket receiver ring, wherein said first and second socket receiver channels are oppositely aligned along a receiver channel axis of said web socket supports, and wherein said plurality of web socket supports are arranged in a first row and a second row transversely aligned to said first row, and said second row is laterally shifted from said first row in a direction parallel to said central shaft, thereby forming four rows of socket receiver channels transversely staggered and laterally shifted relative to said central shaft, said plurality of web socket supports further comprises:

i) an outboard end socket support secured to said outboard end plate; and ii) a drive end socket support secured to said drive end plate;

e) a rotor casing engaged with said webbing for protecting said webbing;

f) a plurality of sockets comprising:

i) an upper end secured to a plurality of throughbores located in said rotor casing;

ii) a lower end for alignment with, and capture by, said socket receiver channels of said web socket supports of said webbing, said lower end also having a socket lock ring with two opposing gaps to allow for releasable securement of said plurality of sockets to said plurality of web socket supports, wherein said plurality of sockets release from said plurality of web socket supports by rotating said plurality of sockets to align said opposing gaps with said web socket receiver ring of said plurality of web socket supports, and said plurality of sockets secure to said plurality of web socket supports by rotating said plurality of sockets such that said socket lock rings of said plurality of sockets are received within said web socket receiver ring of said plurality of web socket supports;

iii) an interior socket thread; and iv) a keyway along an interior side wall of each of said plurality of sockets; and g) a plurality of hammers releasebly secured to said plurality of sockets through threaded engagement between a hammer socket thread of said plurality of hammers and said interior socket threads of said plurality of sockets, and said plurality of hammers further comprising:

i) a plurality of keyways along an exterior side wall of each of said plurality of hammers, wherein when said hammers are secured to said plurality of sockets said keyways align with said keyways of said plurality of sockets to allow insertion of a plurality of keys to lock said hammers in place within said sockets;

ii) a first lubrication thread aligned with a lubrication aperture of said plurality of keys, such that the application of a lubricant into said lubrication aperture and into said first lubrication thread at least partially seals said plurality of hammers and said plurality of sockets; and iii) a second lubrication thread aligned with said lubrication aperture of said plurality of keys such that application of a lubricant into said lubrication aperture and into said second lubrication thread lubricates said interior socket thread of said plurality of sockets and said socket thread of said plurality of hammers.

* * * * *